US008303139B1

(12) United States Patent
Ohm

(10) Patent No.: US 8,303,139 B1
(45) Date of Patent: Nov. 6, 2012

(54) ILLUMINATOR DEVICE HAVING MULTIPLE REFLECTIVE SURFACES

(75) Inventor: Randall C. Ohm, Grand Junction, CO (US)

(73) Assignee: Ohm, Inc., Grand Junction, CO (US)

( * ) Notice: Subject to any disclaimer, the term of this patent is extended or adjusted under 35 U.S.C. 154(b) by 366 days.

(21) Appl. No.: 12/830,496

(22) Filed: Jul. 6, 2010

(51) Int. Cl.
*F21V 7/00* (2006.01)

(52) U.S. Cl. ..... 362/298; 362/346; 362/301; 362/304

(58) Field of Classification Search ..... 362/298, 362/302, 303, 346, 349, 301, 304
See application file for complete search history.

(56) References Cited

U.S. PATENT DOCUMENTS

| | | | | |
|---|---|---|---|---|
| 3,772,506 | A | 11/1973 | Junginger | |
| 4,037,096 | A | 7/1977 | Brendgord | |
| 4,081,667 | A | 3/1978 | Lewin | |
| 4,310,876 | A * | 1/1982 | Small et al. | 362/298 |
| 4,447,865 | A | 5/1984 | VanHorn | |
| 4,587,601 | A | 5/1986 | Collins | |
| 4,701,832 | A * | 10/1987 | Lasker | 362/281 |
| 4,855,885 | A | 8/1989 | MacEachern | |
| 4,897,771 | A | 1/1990 | Parker | |
| 5,317,484 | A | 5/1994 | Davenport | |
| 5,438,485 | A | 8/1995 | Li | |
| 5,582,480 | A * | 12/1996 | Zwick et al. | 362/298 |
| 6,053,623 | A | 4/2000 | Jones | |
| 7,021,806 | B2 * | 4/2006 | Ovenshire | 362/527 |
| 7,946,734 | B2 * | 5/2011 | Laporte | 362/308 |
| 2010/0020545 | A1 * | 1/2010 | Steinberg | 362/297 |

* cited by examiner

*Primary Examiner* — Peggy A. Neils
(74) *Attorney, Agent, or Firm* — Neustel Law Offices

(57) ABSTRACT

An illuminator device for efficiently increasing a projected light intensity. The illuminator device includes a hood for retaining a light source, a first reflector proximally supported by the hood, a second reflector spaced apart from the first reflector and distally supported by the hood, the second reflector aligned with the first reflector, and a third reflector laterally projecting from the hood, the third reflector aligned with the second reflector. The second reflector is adapted to reflect light rays from the light source back to the first reflector, wherein the light rays travel back and forth from the second to the first reflector at least once before being reflected to the third reflector to be directed away from the luminaire. A transparent cover may be supported between the first and second reflectors for containing reflected light rays. A hanging bracket may also be used for hanging the luminaire.

20 Claims, 3 Drawing Sheets

ILLUMINATOR DEVICE HAVING MULTIPLE REFLECTIVE SURFACES

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a light and more specifically it relates to an illuminator device having multiple reflective surfaces for efficiently increasing the projected light intensity.

2. Description of the Related Art

Any discussion of the related art throughout the specification should in no way be considered as an admission that such related art is widely known or forms part of common general knowledge in the field.

Generally, lighting devices require more bulbs or LEDs having increased wattage requirements to increase projected light intensity. The increased light intensity can be usefully in various areas, such as but not limited to street lights, residence lights, vehicle lights, etc. However, the increased light intensity associated with the higher wattage requirements can be very costly, wherein not only does the user have to purchase more expensive and numerous amounts of bulbs and/or LEDs, the user generally has more expensive utility bills to pay for the increased wattage requirements. Because of the inherent problems with the related art, there is a need for a new and improved illuminator device having multiple reflective surfaces for efficiently increasing the projected light intensity.

BRIEF SUMMARY OF THE INVENTION

A system for efficiently increasing the projected light intensity. The invention generally relates to a light which includes a hood for retaining a light source, a first reflector proximally supported by the hood, a second reflector spaced apart from the first reflector and distally supported by the hood, the second reflector aligned with the first reflector, and a third reflector laterally projecting from the hood, the third reflector aligned with the second reflector. The second reflector is adapted to reflect light rays from the light source back to the first reflector, wherein the light rays travel back and forth from the second to the first reflector at least once before being reflected to the third reflector to be directed away from the luminaire. A transparent cover may be supported between the first and second reflectors for containing reflected light rays. A hanging bracket may also be used for hanging the luminaire.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview.

Figure 1:
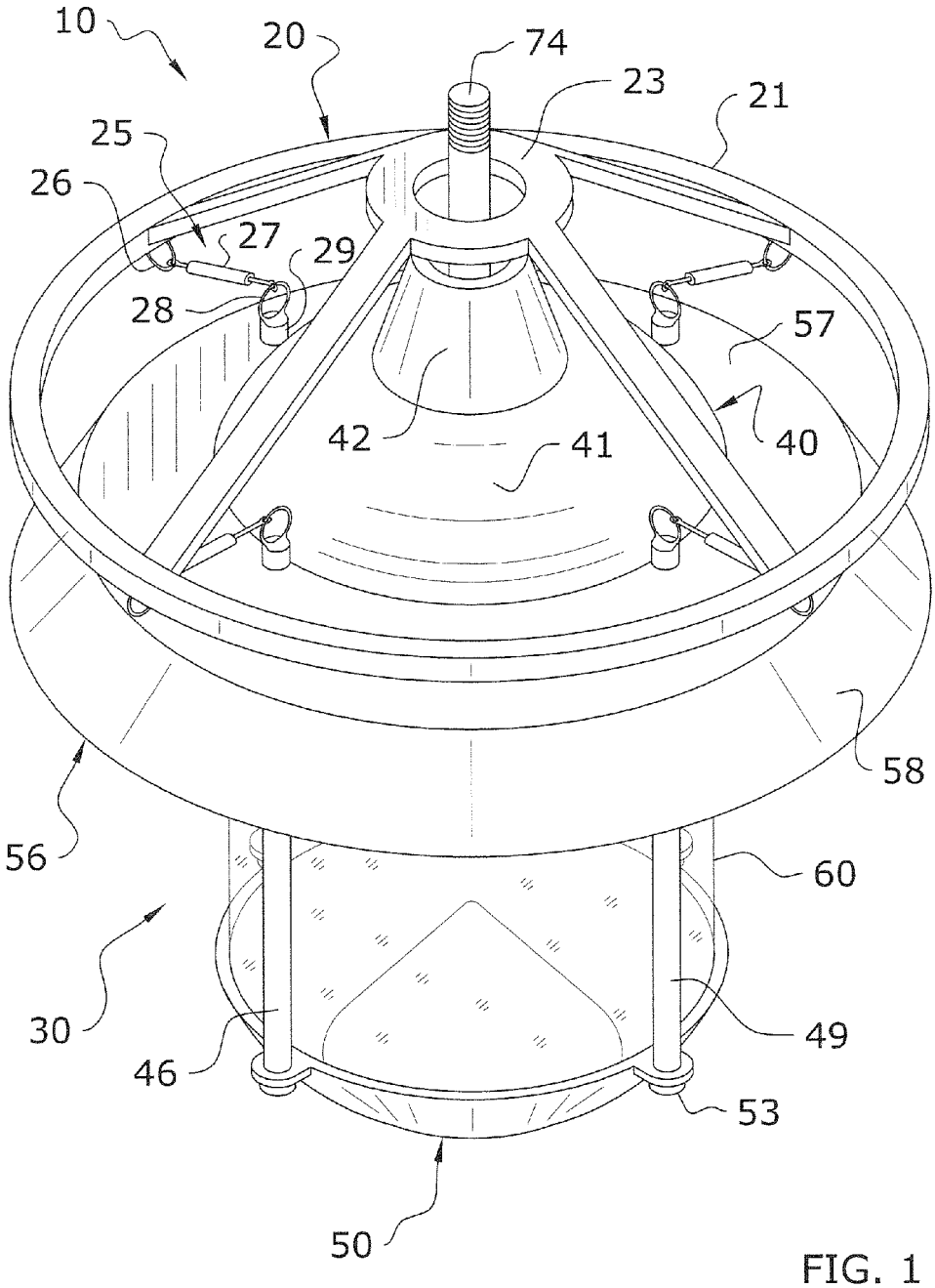
FIG. 1 is an upper perspective view of the present invention.
Figure 2:
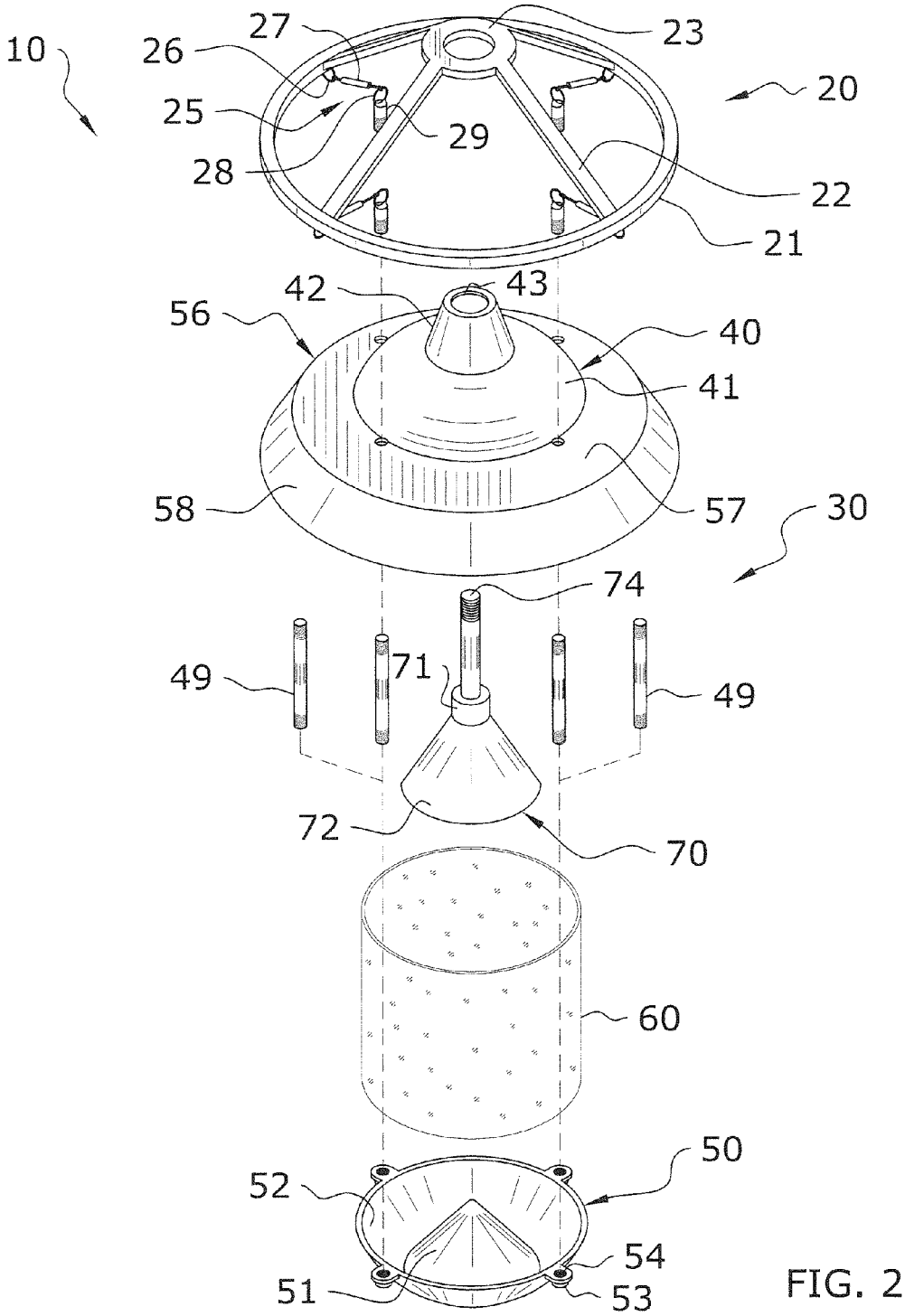
FIG. 2 is an exploded upper perspective view the present invention.
Figure 3:
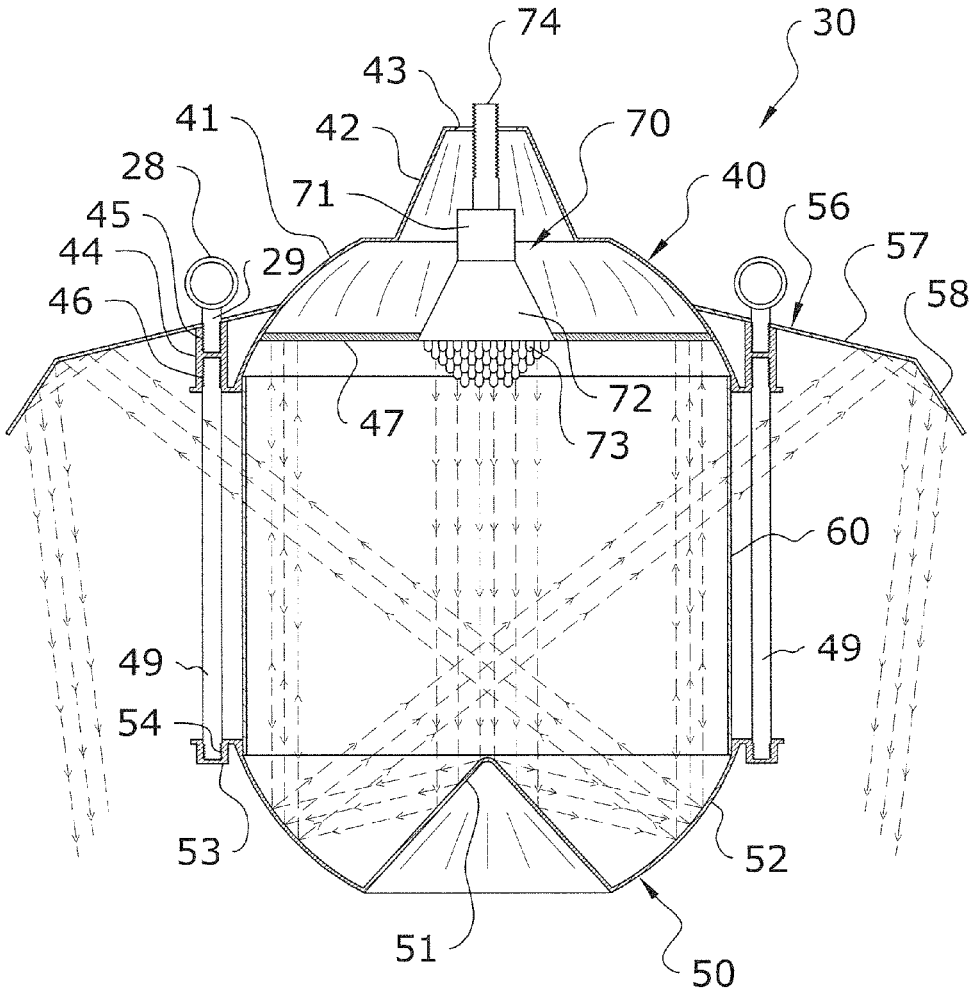
FIG. 3 is a cross-sectional view of the present invention illustrating an exemplary light ray path.

Turning now descriptively to the drawings, in which similar reference characters denote similar elements throughout the several views, FIGS. 1 through 3 illustrate a illuminator device having multiple reflective surfaces 10, which comprises a hood 40 for retaining a light source 73, a first reflector 47 proximally supported by the hood 40, a second reflector 50 spaced apart from the first reflector 47 and distally supported by the hood 40, the second reflector 50 aligned with the first reflector 47, and a third reflector 56 laterally projecting from the hood 40, the third reflector 56 aligned with the second reflector 50. The second reflector 50 is adapted to reflect light rays from the light source 73 back to the first reflector 47, wherein the light rays travel back and forth from the second to the first reflector 47 at least once before being reflected to the third reflector 56 to be directed away from the luminaire 30. A transparent cover 60 may be supported between the first and second reflectors 47, 50 for containing reflected light rays. A hanging bracket 20 may also be used for hanging the luminaire 30.

B. Hanging Bracket.

The light fixture 70 may be retained in a suspended position by a hanging bracket 20 as illustrated in FIGS. 1 and 2. The hanging bracket 20 may be fixed to a support structure, such as a light post, building, etc. in various manners. One embodiment of the hanging bracket 20 includes an outer support ring 21 having a diameter generally larger than the luminaire 30, a plurality of angled supports 22 angling upwardly and inwardly from the outer support ring 21 towards an inner support ring 23 at a terminating end of the angled supports 22. The inner support ring 23 receives the all-threaded connecting post 74 of the light fixture 70 through a center thereof and any electrical wires needed to supply power, etc. to the light fixture 70.

A plurality of connecting supports 25 extend substantially laterally inwardly from the outer ring for connecting with the luminaire 30 along peripherally spaced points. The connecting supports 25 are preferably comprised of a turnbuckle structure, thus having a first ring 26 connected to the outer support ring 21, a longitudinal adjustment member 27 extending from the first ring 26, and a second ring 28 extending from the adjustment member 27 opposite the first ring 26. The adjustment member 27 may be adjusted to adjust a length of the connecting support 25 thus allowing the angle at which the luminaire 30 is directed to be adjusted. The second ring 28 is generally connected to an upper post 29 which is threadably received and retained within the hood 40. The first ring 26 and the second ring 28 may be comprised of alternate structures. The first ring 26 and the second ring 28 are also able to swivel and rotate as necessary.

C. Luminaire.

The luminaire 30 is generally supported in a suspended manner from the light fixture 70. The hood 40 of the luminaire 30 generally includes a first portion 41 comprising a dome shape and a second portion 42 extending upwardly from the first portion 41 and concentric with the first portion 41 comprised of a trapezoidal shape. The second portion 42 includes an opening 43 at an upper end for receiving the connecting post 74 of the light fixture 70 and any electrical wires (not shown). The hood 40 is generally substantially hollow to contain the light fixture 70 substantially therein and any electrical components or circuitry. The interior of the hood 40 is also generally sealed to prevent rain or outside elements from entering the interior and damaging electrical circuitry and/or the light fixture 70.

Extending from a lower end of the first portion 41 is generally a plurality of post retainers 44. The post retainers 44 are preferably spaced around a peripheral edge of the hood 40 to align with upper and lower posts 49 as appreciated. The post retainers 44 generally include an upper threaded slot 45 for receiving the lower end of the upper posts 29 and a lower threaded slot 46 for receiving the upper end of the lower posts 49.

The first reflector 47 is generally located within the hood 40 and more specifically within the first portion 41 of the hood 40 to have a diameter substantially similar to an outer diameter of the first portion 41. The reflective mirror surface of the first reflector 47 is generally oriented downwards away from the hood 40 to be aligned with the second reflector 50. The first reflector 47 may include a central opening 43 for receiving the light fixture 70 as illustrated in FIG. 3. The first reflector 47 is also generally comprised of a stainless steel material to prevent corrosion and increase reflective properties.

The second reflector 50 is distally separated from the first reflector 47 via the cover 60 and the posts as will be described. The reflective mirror surfaces of the second reflector 50 are oriented generally upwards to align with the first reflector 47 and the third reflector 56. The second reflector 50 is generally concentric with the first reflector 47 and has a substantially similar outer diameter as the first reflector 47 to allow light rays to reflect back and forth between the first reflector 47 and the second reflector 50. The second reflector 50 is also generally comprised of a stainless steel material to prevent corrosion and increase reflective properties.

The second reflector 50 generally includes an inner reflective portion 51 and a concentric outer reflective portion 52. The inner reflective portion 51 is aligned with the light fixture 70 and receives incoming light rays from the light fixture 70 as illustrated in FIG. 3. The outer reflective portion 52 curves outwardly from the inner reflective portion 51 and receives reflected light rays from the inner reflective portion 51.

The inner reflective portion 51 is preferably comprised of an upright cone-shaped structure and the outer reflective portion 52 is preferably comprised of an upright bowl shaped structure. The shapes being specific so that the light rays travel along the specified path as illustrated in FIG. 3. As shown, the walls of the inner reflective portion 51 are preferably angled in a straight manner and the walls of the outer reflective portion 52 extend upwardly in a curved manner. The inner reflective portion 51 and the outer reflective portion 52 may also have different reflective properties, such as the inner reflective portion 51 being more reflective than the outer reflective portion 52.

Extending outwardly from a peripheral edge of the second reflector 50 and spaced apart from each other is a plurality of post retainers 53. The post retainers 53 of the second reflector 50 align with the post retainers 53 of the hood 40 to receive posts 49 to secure the second reflector 50 to the hood 40 in a spaced apart relationship and preferably in a vertically spaced apart relationship. Like the upper post retainers 44, the lower post retainers 53 have a threaded slot 54 for receiving an end of the posts 49.

The third reflector 56 projects laterally outwardly from the first portion 41 of the hood 40 as illustrated in FIGS. 1 through 3. The third reflector 56 is used to receive the reflected light rays from the second reflector 50 and direct the light rays towards a focal point(s) below the luminaire 30. The reflective mirror surfaces of the third reflector 56 are generally oriented substantially downward. The third reflector 56 is also generally comprised of a stainless steel material to prevent corrosion and increase reflective properties.

The third reflector 56 generally includes an inner reflective portion 57 extending from the hood 40 and an outer reflective portion 58 angularly extending from the inner reflective portion 57. The inner reflective portion 57 receives light rays from the outer reflective portion 58 of the second reflector 50 and directs the light rays to the outer reflective portion 58 of the third reflector 56 where the light rays are then directed downwards below the luminaire 30 toward the desired focal point(s). It is appreciated that the angle of the outer reflective portion 58 with respect to the inner reflective portion 57 may differ depending on where the focal point is to be located, the focal point being the point where the light rays are directed below the luminaire 30.

The cover 60 is generally located between the hood 40 and the second reflector 50 to both help contain the light rays while being reflected back and forth between the first reflector 47 and the second reflector 50 and also to prevent debris, rain, etc. from entering the space between the hood 40 and the second reflector 50. The cover 60 is transparent to allow the light rays from the second reflector 50 to pass through to engage the third reflector 56 as illustrated in FIG. 3. The cover 60 is also generally tubular in structure to match the peripheral edge of the second reflector 50 and the hood 40 as illustrated in FIGS. 1 and 2. The upper end of the cover 60 is generally retained along an inside of the peripheral edge of the first portion 41 below the first reflector 47 and the lower end of the cover 60 is generally retained along an inside of the peripheral edge of the second reflector 50 as illustrated in FIG. 3.

The light fixture 70 is retained in position within the hood 40 of the luminaire 30. Generally, the light fixture 70 includes a socket 71 retained within the hood 40, a casing 72 extending from the socket 71 and directed towards the first reflector 47 and a light source 73, such as one or more LEDs or bulbs supported within the casing 72, wherein the light source 73 is directed towards the inner reflective portion of the second reflector 50 and are introduced within the space between the hood 40 and the second reflector 50 through the first reflector 47. A connecting post 74 extends from the socket 71 through the opening 43 of the second portion 42 of the hood 40 to connect to a support structure, etc.

D. Operation of Preferred Embodiment.

In use, the light source 73 directs the light rays towards the inner reflective portion 51 of the second reflector 50, where the light rays are then directed towards the outer reflective portion 52 of the second reflector 50 to be directed back towards the first reflector 47. The light rays travel back and forth between the second reflector 50 and the first reflector 47 at least once and preferably a plurality of times, each time the light rays hit the outer reflective portion 52 of the second reflector 50, the light rays move slightly down along the curved outer reflective portion 52 of the second reflector 50 until the light rays engage an angle of the outer reflective portion 52 to cause the light rays to be directed towards the inner reflective portion 57 of the third reflector 56.

The light rays then are directed towards the outer reflective portion 58 of the third reflector 56 from the inner reflective portion 57 and down towards the desired focal point(s). It is appreciated that the luminaire 30 may be oriented in various other directions to direct the light rays horizontally, upward, or various other directions. Each time the light is reflected or refracted, the light rays increase in intensity, thus allowing the light source 73 to appear to have a much higher wattage and brightness than is actually the case. Thus, a lesser wattage light source 73 may be used to achieve a brightness normally associated with a higher wattage light source.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A luminaire for increasing the intensity of a light fixture, comprising:

a hood for retaining a light fixture;

a first reflector proximally supported by said hood;

a second reflector spaced apart from said first reflector and distally supported by said hood, said second reflector aligned with said first reflector; and a third reflector laterally projecting from said hood, said third reflector aligned with said second reflector;

said second reflector adapted to reflect light rays from said light fixture back to said first reflector;

said light rays adapted to travel from said second reflector to said first reflector and back to said second reflector at least once before being reflected to said third reflector.

said second reflector adapted to reflect said light rays received from said first reflector to said third reflector for being reflected away from said luminaire.

2. The luminaire of claim 1, wherein said first reflector and said second reflector are concentric.

3. The luminaire of claim 1, wherein said first reflector, said second reflector, and said third reflector are concentric.

4. The luminaire of claim 1, wherein said second reflector has an inner reflective portion and an outer reflective portion, said inner reflective portion is aligned with said light fixture and said outer reflective portion is aligned with said inner reflective portion.

5. The luminaire of claim 4, wherein said inner reflective portion is comprised of an upright cone shape and wherein said outer reflective portion is comprised of an upright bowl shape.

6. The luminaire of claim 1, wherein said first reflector and said second reflector are substantially similar in diametric size.

7. The luminaire of claim 6, wherein said third reflector is substantially larger in diametric size than said first reflector and said second reflector.

8. The luminaire of claim 1, wherein said third reflector has an inner reflective portion and an outer reflective portion, said inner reflective portion is aligned with said second reflector and said outer reflective portion is aligned with said inner reflective portion.

9. The luminaire of claim 1, including a transparent cover extending between said first reflector and said second reflector, said transparent cover adapted to contain light rays reflected between said first reflector and said second reflector.

10. The luminaire of claim 1, including a hanging bracket extending from said hood for hanging said luminaire.

11. The luminaire of claim 1, including a plurality of elongated posts connecting said hood to said second reflector.

12. A luminaire for increasing the intensity of a light fixture, comprising:

a hood for retaining a light fixture;

a first reflector proximally supported by said hood;

a second reflector spaced apart from said first reflector and distally supported by said hood;

wherein said second reflector has an inner reflective portion and an outer reflective portion, said inner reflective portion of said second reflector is aligned with said light fixture and said outer reflective portion of said second reflector is aligned with said inner reflective portion of said second reflector;

wherein said outer reflective portion of said second reflector is aligned with said first reflector; and a third reflector laterally projecting from said hood;

wherein said third reflector has an inner reflective portion and an outer reflective portion, said inner reflective portion of said third reflector is aligned with said outer reflective portion of said second reflector and said outer reflective portion of said third reflector is aligned with said inner reflective portion of said third reflector;

said light rays adapted to travel from said outer reflective portion of said second reflector to said first reflector and back to said outer reflective portion of said second reflector at least once before being reflected to said inner reflective portion of said third reflector;

said outer reflective portion of said third reflector adapted to reflect said light rays away from said luminaire.

13. The luminaire of claim 12, wherein said first reflector and said second reflector are concentric.

14. The luminaire of claim 12, wherein said first reflector, said second reflector, and said third reflector are concentric.

15. The luminaire of claim 12, wherein said inner reflective portion of said second reflector is comprised of an upright cone shape and wherein said outer reflective portion of said second reflector is comprised of an upright bowl shape.

16. The luminaire of claim 12, wherein said first reflector and said second reflector are substantially similar in diametric size.

17. The luminaire of claim 16, wherein said third reflector is substantially larger in diametric size than said first reflector and said second reflector.

18. The luminaire of claim 12, including a transparent cover extending between said first reflector and said second reflector, said transparent cover adapted to contain light rays reflected between said first reflector and said second reflector.

19. The luminaire of claim 12, including a hanging bracket extending from said hood for hanging said luminaire.

20. An illuminator device, comprising:

a hanging bracket having an outer support ring, an inner support ring, and a plurality of angled supports connecting said outer support ring and said inner support ring;

wherein said hanging bracket includes a plurality of turnbuckle connecting supports extending inwardly from said outer support ring;

a luminaire supported by said plurality of turnbuckle connecting supports of said hanging bracket;

said luminaire having a hood for retaining a light fixture;

said luminaire having a first reflector proximally supported by said hood;

said luminaire having a second reflector spaced apart from said first reflector and distally supported by said hood, said second reflector aligned with said first reflector; and said luminaire having a third reflector laterally projecting from said hood, said third reflector aligned with said second reflector;

said second reflector adapted to reflect light rays from said light fixture back to said first reflector;

said light rays adapted to travel from said second reflector to said first reflector and back to said second reflector at least once before being reflected to said third reflector;

said second reflector adapted to reflect said light rays received from said first reflector to said third reflector for being reflected away from said luminaire;

said first reflector, said second reflector, and said third reflector are concentric;

said second reflector has a first inner reflective portion and a first outer reflective portion, said first inner reflective portion is aligned with said light fixture and said first outer reflective portion is aligned with said first inner reflective portion;

said first inner reflective portion is comprised of an upright cone shape and wherein said first outer reflective portion is comprised of an upright bowl shape;

said first reflector and said second reflector are substantially similar in diametric size;

said third reflector is substantially larger in diametric size than said first reflector and said second reflector;

said third reflector has a second inner reflective portion and a second outer reflective portion, said second inner reflective portion is aligned with said second reflector and said second outer reflective portion is aligned with said second inner reflective portion;

a transparent cover extending between said first reflector and said second reflector, said transparent cover adapted to contain light rays reflected between said first reflector and said second reflector; and a plurality of elongated posts connecting said hood to said second reflector.

* * * * *